US008153914B2

(12) United States Patent
Koch et al.

(10) Patent No.: US 8,153,914 B2
(45) Date of Patent: Apr. 10, 2012

(54) SWITCHING DISTRIBUTION BOARD

(75) Inventors: Klaus Koch, Schlegel (DE); Reinhard Capito, Meerbusch (DE)

(73) Assignee: ADC GmbH, Berlin (DE)

( * ) Notice: Subject to any disclaimer, the term of this patent is extended or adjusted under 35 U.S.C. 154(b) by 441 days.

(21) Appl. No.: 12/369,533

(22) Filed: Feb. 11, 2009

(65) Prior Publication Data

US 2009/0205938 A1 Aug. 20, 2009

(30) Foreign Application Priority Data

Feb. 12, 2008 (DE) ..... 10 2008 008 590

(51) Int. Cl.
*H01H 9/00* (2006.01)

(52) U.S. Cl. ..... 200/4; 200/11 TC; 200/17 R

(58) Field of Classification Search ..... 361/601, 361/602, 622, 624, 627–632, 641, 643, 644, 361/647; 307/40, 112, 115, 119, 120, 139; 370/357, 537; 200/1 R, 11 R–11 TW, 17 R, 200/18, 175–179
See application file for complete search history.

(56) References Cited

U.S. PATENT DOCUMENTS 2,701,824 A 2/1955 Ulrich et al.
3,590,175 A * 6/1971 Bleibtreu et al. ..... 200/11 TC
3,936,623 A * 2/1976 Shimoda ..... 200/500
4,025,746 A * 5/1977 Owen ..... 200/179
4,129,817 A * 12/1978 Yew et al. ..... 320/118
4,939,319 A * 7/1990 Bleibtreu ..... 200/11 TC
5,051,548 A * 9/1991 Underwood et al. ..... 200/11 D
5,216,574 A * 6/1993 Marmonier ..... 361/605
6,710,268 B2 * 3/2004 Roos ..... 200/1 R
7,142,132 B2 * 11/2006 Katrak et al. ..... 341/2
7,508,823 B2 * 3/2009 Ali ..... 370/357

FOREIGN PATENT DOCUMENTS

WO WO 2006/119625 A1 11/2006

OTHER PUBLICATIONS

Bergmann et al. "Lehrbuch der Fernmeldetechnik." *Fachverlag Schielle & Schon GmbH.* 1968. pp. 5-6, 293-303.

* cited by examiner

*Primary Examiner* — Michael Friedhofer

(74) *Attorney, Agent, or Firm* — Merchant & Gould P.C.

(57) ABSTRACT

The invention relates to a switching distribution board (1), comprising a number of m input contact pairs (2) and n output contact pairs (16), it being possible for an input contact pair (2) to be connected to any desired output contact pair (16) by a mechanical switching mechanism, the mechanical switching mechanism being driven by at least one motor (5).

10 Claims, 3 Drawing Sheets

SWITCHING DISTRIBUTION BOARD

This application is claims benefit of Serial No. 10 2008 008 590.1, filed 12 Feb. 2008 in Germany and which application is incorporated herein by reference. To the extent appropriate, a claim of priority is made to the above disclosed applications.

BACKGROUND OF THE INVENTION

The invention relates to a switching distribution board for telecommunications and data technology.

Switching distribution boards in communications and data technology are known in various embodiments. A typical design comprises m input contact pairs and n output contact pairs. In this case, n, m are natural numbers, in which case m can be greater than, less than or equal to n. In this case, applications are known where a high degree of flexibility is desired, so that an input contact pair can be connected to any desired output contact pair. This is achieved, for example, by means of switching matrices. The advantage of such switching distribution boards is that they can be operated by remote control and therefore save on time-consuming manual jumper work. One disadvantage with the known switching matrices is the fact that they require a relatively large amount of space. A further disadvantage is the relatively high switching power and therefore the power required, in particular if the switching distribution board needs to be supplied by means of a remote feed.

SUMMARY OF THE INVENTION

The invention is therefore based on the technical problem of providing a switching distribution board which has a more compact design and produces less in the way of heat losses.

In this regard, the switching distribution board has a number of m input contact pairs and n output contact pairs, it being possible for an input contact pair to be connected to any desired output contact pair by a mechanical switching mechanism, the mechanical switching mechanism being driven by at least one motor. As a result, the heat losses can be reduced to the actual switching process. In this case, mention is made of the fact that the term input contact pair or output contact pair results from the fact that twin wires are usually connected.

In a preferred embodiment, the input contact pairs are arranged on a ring structure, the input contacts extending in the longitudinal direction so that a cylindrical structure results, elements in the form of circular rings being arranged one above the other within the cylindrical structure, one element in the form of a circular ring being associated with each output contact pair, and it being possible for the element to be driven by the at least one motor in order to optionally connect an output contact pair to an input contact pair.

In a further preferred embodiment, the mechanical switching mechanism is driven by precisely one motor. This results in a particularly compact design.

In a further preferred embodiment, a rigid mechanical holding structure is arranged within the cylindrical structure, on which holding structure the elements in the form of circular rings are arranged, it being possible for the elements in the form of circular rings to be connected to a drive shaft of the motor by means of a coupling.

In a further preferred embodiment, the coupling is in the form of a relay.

In a further preferred embodiment, the output contacts are guided to an outer side of the switching distribution board via the rigid mechanical holding structure.

In a further preferred embodiment, the input contacts are in the form of metallic perforated strips.

In a further preferred embodiment, the switching distribution board comprises a control unit, via which the interconnection between the input and output contacts can be changed.

In a further preferred embodiment, the control unit is in the form of an optically controlled control unit.

In a further preferred embodiment, optical waveguides are arranged between the input contacts and extend in the longitudinal direction, in each case one optical transmission and reception unit being arranged on the elements in the form of circular rings, which optical transmission and reception unit is evaluated and driven by an electrical control unit on the element in the form of a circular ring.

In a further preferred embodiment, the electrical voltage supply for the electrical control units is led onto the elements in the form of circular rings by the drive shaft.

BRIEF DESCRIPTION OF THE DRAWINGS

The invention will be explained in more detail below with reference to a preferred exemplary embodiment. In the figures.

DETAILED DESCRIPTION OF THE PREFERRED EMBODIMENTS

Figure 1:
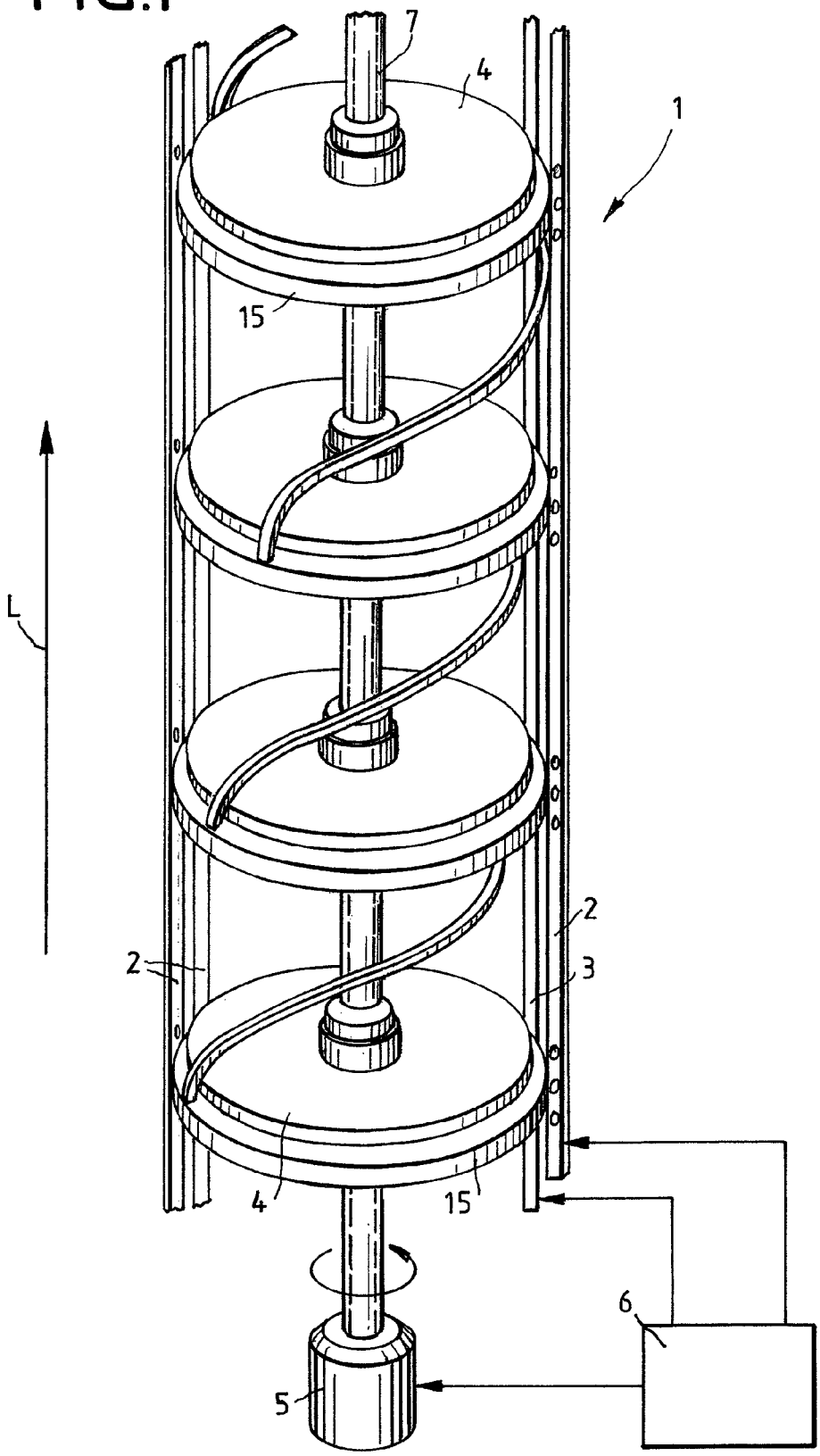
FIG. 1 shows a schematic illustration of a distribution board.

The switching distribution board 1 comprises a number of m input contact pairs 2, for reasons of clarity only one complete input contact pair 2 being illustrated on the left and a further input contact of an input contact pair 2 being illustrated on the right in FIG. 1. An optical waveguide 3 is arranged between in each case two input contact pairs 2, for reasons of clarity likewise only one waveguide 3 being illustrated. Furthermore, the switching distribution board 1 comprises a contact pair for a parking position and a contact pair for a measuring line. The input contact pairs 2, the optical waveguides 3 and the contact pairs for the parking position and the measuring line extend in the longitudinal direction L and are arranged concentrically on a virtual circle. Elements 4 in the form of circular rings are arranged in the cylinder formed in this way, one element 4 in the form of a circular ring being associated with each output contact pair, only four elements 4 in the form of circular rings being illustrated for reasons of clarity. Furthermore, the switching distribution board 1 comprises a motor 5 and a control unit 6. A drive shaft 7 of the motor 5 passes through all the elements 4 in the form of circular rings, which for this purpose each have a through-opening in the center. The control unit 6 firstly drives the motor 5 and is optically connected to the optical waveguides 3. The elements 4 in the form of circular rings are arranged on a rigid mechanical holding structure 15. The mechanical holding structure 15 has ring-shaped supports, which are connected to one another in the form of a spiral staircase, corresponding to the number of ring-shaped elements 4. The mechanical holding structure 15 can in this case be designed to have one or more parts, it being necessary to ensure, depending on the embodiment, that the various ring-shaped elements 4 can reach onto the ring-shaped supports. Given a single-part design, the ring-shaped element 4 can be designed to be slotted, for example. Given the multi-part variant, the ring-shaped elements 4 can be positioned on the respective ring-shaped supports and then the ring-shaped supports can be connected to one another.

Figure 2:
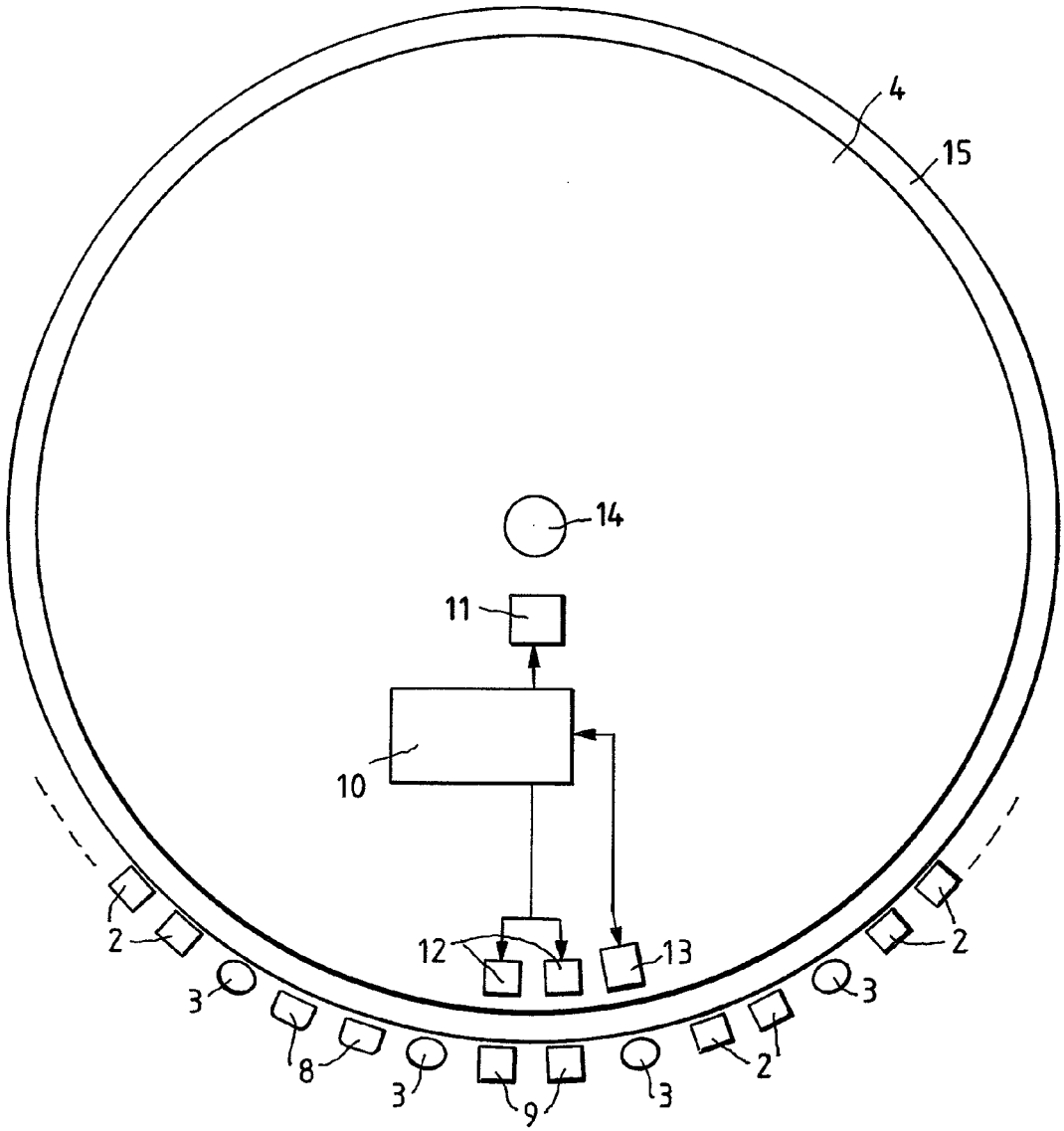
FIG. 2 shows a schematic plan view of an element in the form of a circular ring.

FIG. 2 illustrates an element 4 in the form of a circular ring in a plan view. The input contact pairs 2, the contact pair 8 for the parking position and the contact pair 9 for the measuring line are arranged concentrically around the element 4 in the form of a circular ring, an optical waveguide 3 being arranged in each case between a contact pair 2, 8, 9. An electrical control unit 10 is arranged on the element 4 in the form of a circular ring, which control unit 10 is connected to a relay 11, a relay pair 12 and an optical transmission and reception unit 13. Furthermore, the through-opening 14 for the drive shaft 7 of the motor 5 is illustrated.

A possible drive method for changing the interconnection between the input contact pairs 2 and an output contact pair will now be explained in more detail below. The control unit 6 knows the position of all the elements 4 in the form of circular rings and therefore knows which input contact pair 2 is connected to which output contact pair. If, in the example illustrated, the output contact pair which is at present connected to the contact pair 9 for the measuring line is now intended to be connected to the input contact pair 2 which is adjacent on the left, the control unit 6 first drives the optical waveguide 3 which is opposite the transmission and reception unit 13. This drive signal is, for example, an optical pulse having a specific length. This drive signal is detected by the transmission and reception unit 13 and communicated to the electrical control unit 10. The electrical control unit 10 now drives the relay 11, as a result of which the element 4 in the form of a circular ring is coupled to the drive shaft 7 (not illustrated in FIG. 2) of the motor 5. The coupling can in this case take place, for example, by means of a sleeve coupling or by means of contact pins, which engage in openings of the drive shaft 7. At the same time, the relay pair 12 is opened. The control unit now drives the motor 5, which then rotates the drive shaft 7, so that the element 4 in the form of a circular ring rotates, since the latter is coupled to the drive shaft 7 by the relay 11. The optical waveguide 3 is driven by the control unit 6 at the position in which the element 4 in the form of a circular ring is intended to stop. If the optical transmission and reception unit 13 now detects the driven optical waveguide 3, this information is communicated to the control unit 10. The latter then switches the relay 11, so that the element 4 in the form of a circular ring is decoupled from the drive shaft 7. Furthermore, the relay pair 12 is switched in such a way that the input contact pair 2 is connected to the output contact pair, which will be explained in more detail with reference to FIG. 3. The control unit 10 communicates, via the transmission and reception unit 13, to the control unit 6 the fact that the element 4 in the form of a circular ring is at the correct position. For this purpose, the transmission and reception unit 13 couples, for example, light pulses or differently colored light into the optical waveguide 3.

Figure 3:
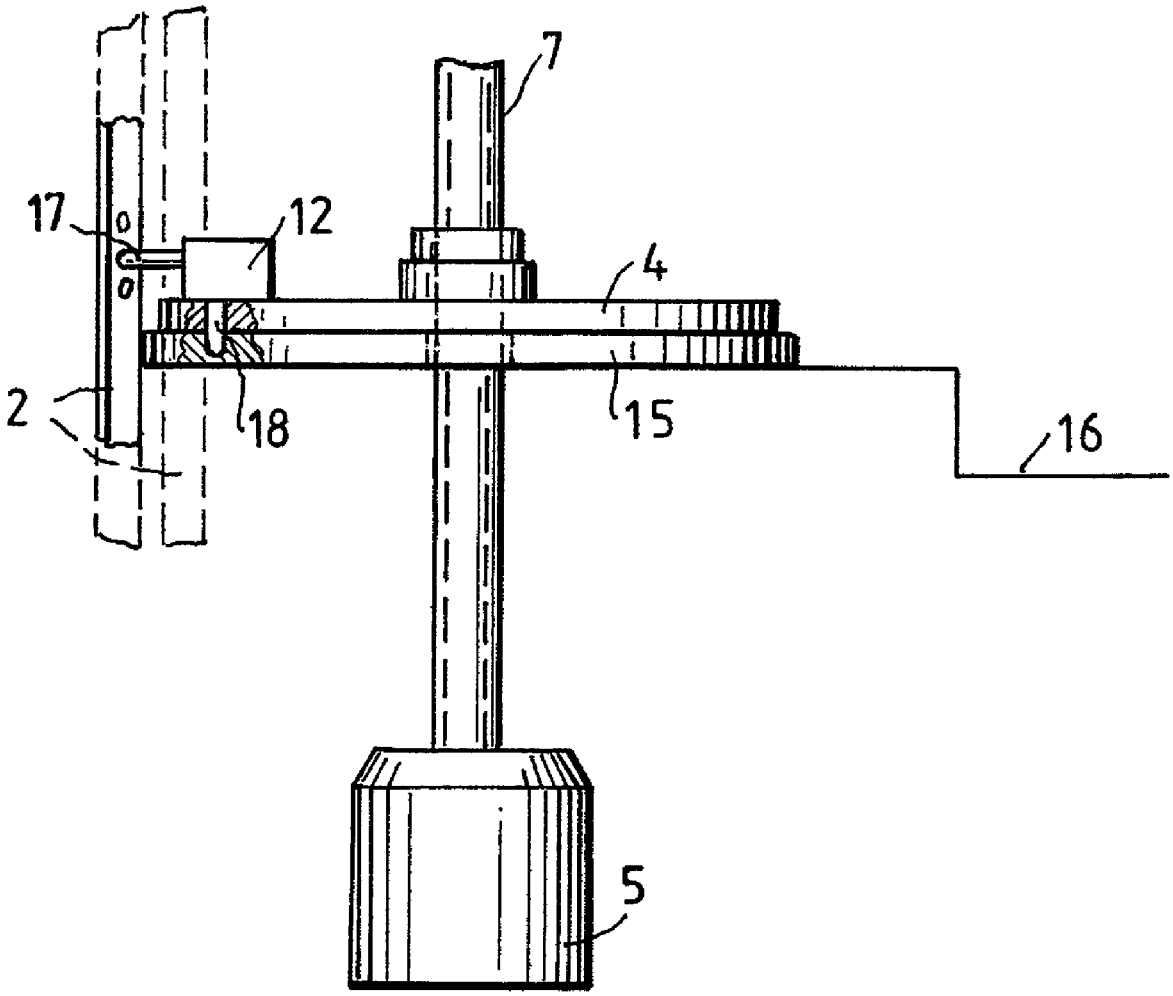
FIG. 3 shows a schematic side view of an element in the form of a circular ring.

FIG. 3 illustrates an element 4 in the form of a circular ring in a side view, a relay of the relay pair 12 being visible. The element 4 in the form of a circular ring is arranged on the rigid mechanical holding structure 15, only the ring-shaped support being illustrated. The holding structure 15 or the ring-shaped supports in this case likewise have central through-openings for the drive shaft 7 of the motor 5, which are aligned with the through-openings 14 of the elements 4 in the form of circular rings.

The support of the holding structure 15 of an element 4 in the form of a circular ring has contact bores, from which conductor tracks are led to an output contact pair 16. In order to interconnect an input contact pair 2 and the associated output contact pair 16 of an element 4 in the form of a circular ring, the relay pair 12 is driven. Each relay of the relay pair 12 has two contact pins 17, 18, which are then moved out. The contact pin 17 then moves into a bore of the input contact and the contact pin 18 moves into the associated bore in the support face, the two contact pins 17, 18 being electrically connected to one another via the relay. As a result, the input contact is electrically connected to the output contact. This takes place in pairs in each case. The contact pins 17, 18 can in this case be designed to be conical in order to achieve a sufficient and defined contact force in the bores. The electrical voltage supply of the control units 10 can in this case take place via batteries or else the voltage supply lines are led through the drive shaft to the individual elements 4 in the form of circular rings. The number of input contact pairs 2 can be, depending on the application, less than, equal to or greater than the number of output contact pairs 16; the number of elements 4 in the form of circular rings corresponds to the number of output contact pairs plus the elements 4 in the form of circular rings for measuring lines. The input contact pairs 2 and the output contact pairs 16 can in this case be formed with wire connection contacts, for example with insulation displacement contacts or wire-wrap contacts. In the parking position, an output contact is not connected to an input contact.

| List of reference symbols | |
|---|---|
| 1 | Switching distribution board |
| 2 | Input contact pairs |
| 3 | Optical waveguide |
| 4 | Element in the form of a circular ring |
| 5 | Motor |
| 6 | Control unit |
| 7 | Drive shaft |
| 8 | Contact pair for the parking position |
| 9 | Contact pair for the measuring line |
| 10 | Electrical control unit |
| 11 | Relay |
| 12 | Relay pair |
| 13 | Transmission and reception unit |
| 14 | Through-opening |
| 15 | Holding structure |
| 16 | Output contact pairs |
| 17, 18 | Contact pins |
| L | Longitudinal direction |

The invention claimed is:

1. A switching distribution board, comprising:

a number of m input contact pairs and n output contact pairs, it being possible for an input contact pair to be connected to any desired output contact pair by a mechanical switching mechanism, the mechanical switching mechanism being driven by precisely one motor.

2. The switching distribution board as claimed in claim 1, wherein the input contact pairs are arranged on a ring structure, the input contact pairs extending in the longitudinal direction (L) so that a cylindrical structure results, elements in the form of a plurality of circular rings being arranged one above the other within the cylindrical structure, an element in the form of a circular ring being associated with each output contact pair, and it being possible for the element to be driven by the at least one motor in order to optionally connect an output contact pair to an input contact pair.

3. The switching distribution board as claimed in claim 2, wherein the input contacts are in the form of metallic perforated strips.

4. The switching distribution board as claimed in claim 1, wherein the switching distribution board comprises a control unit, via which the interconnection between the input and output contacts can be changed.

5. The switching distribution board as claimed in claim 4, wherein the control unit is in the form of an optically controlled control unit.

6. The switching distribution board as claimed in claim 5, wherein optical waveguides are arranged between the input contacts and extend in the longitudinal direction (L), in each case one optical transmission and reception unit being arranged on the elements in the form of circular rings, which optical transmission and reception unit is evaluated and driven by an electrical control unit on the element in the form of a circular ring.

7. The switching distribution board as claimed claim 1, wherein the electrical voltage supply for the electrical control units is led onto the elements in the form of circular rings by the drive shaft.

8. A switching distribution board, comprising:

a number of m input contact pairs and n output contact pairs, it being possible for an input contact pair to be connected to any desired output contact pair by a mechanical switching mechanism, the mechanical switching mechanism being driven by at least one motor, wherein the input contact pairs are arranged on a ring structure, the input contact pairs extending in the longitudinal direction (L) so that a cylindrical structure results, elements in the form of a plurality of circular rings being arranged one above the other within the cylindrical structure, an element in the form of a circular ring being associated with each output contact pair, and it being possible for the element to be driven by the at least one motor in order to optionally connect an output contact pair to an input contact pair; and wherein a rigid mechanical holding structure is arranged within the cylindrical structure, on which holding structure the elements in the form of circular rings are arranged, it being possible for the elements in the form of circular rings to be connected to a drive shaft of the motor by means of a coupling.

9. The switching distribution board as claimed in claim 8, wherein the coupling is in the form of a relay.

10. The switching distribution board as claimed in claim 8, wherein the output contacts are guided to an outer side of the switching distribution board via the rigid mechanical holding structure.

* * * * *